252-105 AU 166 EX

6/2/81 XR 4,270,932

United States Patent [19]

Perovetz et al.

[11] 4,270,932

[45] Jun. 2, 1981

[54] POLISHING OF SILVER-PLATED ARTICLES

[75] Inventors: Lawrence M. Perovetz, Stanmore; Harold J. Stern, Hammersmith Grove, both of England

[73] Assignee: H.L.P. Imports Ltd., London, England

[21] Appl. No.: 18,938

[22] Filed: Mar. 9, 1979

[30] Foreign Application Priority Data

Apr. 24, 1978 [GB] United Kingdom ..... 16047/78

[51] Int. Cl.[3] ..... B24D 17/00

[52] U.S. Cl. ..... 51/293; 51/303; 51/307; 51/309; 106/1.23; 106/3; 252/105

[58] Field of Search ..... 51/293, 309, 303, 307; 106/3, 1.23; 252/105

[56] References Cited

U.S. PATENT DOCUMENTS

| | | | |
|---|---|---|---|
| 3,425,947 | 2/1969 | Rausch et al. | 51/307 |
| 3,754,878 | 8/1973 | Burke | 51/307 |

FOREIGN PATENT DOCUMENTS

| | | |
|---|---|---|
| 1491 | of 1903 | United Kingdom . |
| 327479 | 4/1930 | United Kingdom . |
| 383726 | 11/1932 | United Kingdom . |

OTHER PUBLICATIONS

The Merck Index, 9th Ed., (1976), p. 5472.

*Primary Examiner*—Donald E. Czaja
*Assistant Examiner*—W. Thompson
*Attorney, Agent, or Firm*—Lowe, King, Price & Becker

[57] ABSTRACT

The invention relates to the polishing of silver-plated, in particular electro-plated silver. The feature of the invention is the provision of a formulation which in the dry, solid state has a high storage life and is free of any toxic components and therefore usable in the home in hotels and in like establishments. The formulation comprises in powdered form at least one silver generating component such as a silver salt or silver oxide and at least one reducing component for the salt or oxide. When water is added to this dry powdered composition to form a paste as needed, and the paste is used on a plated base metal or alloy for cleaning and/or restoration purposes, silver is both deposited and polished by the use of the composition. Different qualities of finish may be obtained depending upon whether the solid formulation also comprises in powdered form either one of the conventional relatively harsh abrasives such as rouge or a very mild agent such as one of the conventional fillers, e.g. Bentonite or Fullers Earth.

17 Claims, No Drawings

POLISHING OF SILVER-PLATED ARTICLES

FIELD OF THE INVENTION

This invention relates to the polishing of silver-plated articles, in particular electroplated silver articles or antique Sheffield plate, i.e. plate obtained on hard metal such as nickel or copper.

BACKGROUND OF THE INVENTION

The problem of the tarnishing of silver, particularly in large towns or where industrial atmospheres are prevalent, has been encountered for many years. In the case of atmospheres polluted by the presence of hydrogen sulphide, silver sulphide is formed on the surface of the silver-plated article as a result of the reaction which takes place in the presence of oxygen.

DESCRIPTION OF THE PRIOR ART

The various conventional polishing compositions, including powders, pastes, foams and liquids, all rely on the removal of the tarnish either by mechanical action due to abrasive components in the powders or pastes, or chemical action due to materials dissolved in the cleaning liquids which react with silver sulphide, the tarnish being dissolved from the surface of the plated article.

In either case, the polishing action involves the removal of minute amounts of silver. Repeated polishing carried out on the layer of silver which is only several microns thick at most must inevitably lead, after a period of time, to exposure of the underlying base metal. If the base metal is exposed over a sufficiently large area, the only satisfactory recourse has been for the article to be electroplated once again which is an expensive procedure.

On the other hand, it has been known for a considerable time that silver is deposited from a silver salt in the presence of a reducing agent. However, this procedure is only carried out on a commercial or industrial scale with the use of a cyanide such as potassium cyanide in order to give a coherent deposit. The use of cyanides makes the process dangerous and undesirable from the viewpoint of the operators who can only carry it out under strictly controlled conditions.

Canadian Specification No. 930902 granted to Svend Yound and Klaus Mueller of Toronto, Ontario, Canada on July 31st, 1978 refers to the polishing and cleaning and restoring of silver and silver-plated metals. This involves the deposition of a molecular layer of silver upon, and the chemical bonding of the layer to, the article being cleaned. The formulation contains silver in a molecular state suspended in a chemical solution. A so-called silver complexing agent is used to achieve this suspension. It is stated that any substance capable of forming a complex with the silver may be used but the only specific disclosure of a complexing agent is sodium cyanide. This formulation is toxic if ingested directly and therefore cannot be put on the market for domestic use in the home or, e.g. in hotels or like establishments, because of the danger to operatives it would represent.

BRIEF SUMMARY OF THE INVENTION

We have now discovered that the polishing of silver-plated, in particular electroplated silver or Sheffield plate articles, can be carried out satisfactorily in the home by the use of compositions which restore to the polished article at least as much silver as is removed in the polishing operation and which therefore can be carried out repeatedly over lengthy periods of time without the base metal being exposed, thereby obviating the need for the article to be replated under commercial conditions either by electroplating or commercial silver-plating involving the use of the dangerous cyanides as mentioned above.

DETAILED DESCRIPTION OF THE INVENTION

According to one aspect of our invention, we provide a method of polishing a silver-plated, in particular an electroplated silver article comprising the steps of applying to at least part of the surface or the article a paste comprising at least one silver salt and/or silver oxide together with a reducing agent for the salt and/or oxide and, optionally, at least one polishing agent; allowing the paste to remain on the surface to which it has been applied for a period of at least a few seconds; and thereafter removing the paste by the application to the coated article of a fabric, the removal of the paste being accompanied and/or followed by the rubbing of the coated portions of the surface with the fabric.

According to another aspect of our invention, we provide a solid formulation for use as a polishing composition said solid formulation comprising at least one silver generating component selected from the group consisting of silver salts and silver oxides, at least one reducing component for the silver provider and optionally at least one polishing component selected from the group consisting of conventional abrasives and conventional solid fillers, said silver generating component, reducing component and polishing component being all present in powdered form. The powdered formulation may be sold in a single container or in a multi-pack container. In use, individual portions of the powder are simply mixed by the operator when needed with the amount of water needed to make the powder into a fairly thick paste. The resulting aqueous paste is then used by the operator on the article to be cleaned or polished. An important feature of the polishing composition of the invention is that it may be used successively to build up a thicker layer of deposited silver on the article to be cleaned where base metal is exposed than can be achieved by single application. Another feature is that, in contrast to liquid suspensions or pastes which always present storage problems, the solid formulations have been found perfectly satisfactory in storage for periods of a year or more. This is of major importance when it is considered that suspensions of polishing materials in polar or non-polar media tend to solidify upon prolonged storage becoming eventually useless.

Contrary to what would have been expected from the prior art, our experiments have shown that various mixtures of silver salts and/or silver oxide with suitable reducing agents function as satisfactory polishing compositions with the considerable advantage that the application of such pastes and subsequent removal by rubbing or polishing as indicated above leads to the addition or replacement of silver on the surface and therefore avoids the danger of conventional polishing compositions which is the exposure of the base metal after repeated polishing operations.

Our experiments have also shown that if either conventional polishing agents are omitted altogether or very mild agents such as Bentonite or Fullers Earth are used, then a surface with a patina corresponding to that of antique plate can be obtained which is advantageous in certain circumstances.

On the other hand, if a so-called bright finish is needed, then it is necessary to include varying amounts of conventional polishing agents such as the diatomaceous earths, e.g., Kieselguhr often obtained as Celite (trade mark), rouge (red ferric oxide) or calcium carbonate, e.g., in the form of whiting or Newburg chalk.

Although we have found that silver oxide is a perfectly satisfactory source of silver, we have also obtained good results by using silver nitrate, silver chloride, silver carbonate, silver acetate and silver phosphate, all of which are readily available in commerce. Various forms of reducing agent may be used but a preferred material is so-called cream of tartar or potassium hydrogen tartrate. We may, however, also use sodium potassium tartrate, sodium sulphite, sodium metabisulphate or sodium thiosulphate. Sodium thiosulphate is less practicable because of the strong smell of sulphur dioxide which would be evolved.

We have also found in many cases that the composition is improved by the presence of a chloride such as sodium chloride or an ammonium chloride. The precise effect of the sodium chloride is not entirely clear but is believed to function as a source of chloride ions. It is also possible that in compositions which do not contain conventional polishing agents the sodium chloride acts to some extent as a polishing agent until it has been fully absorbed by the chemical reactions which take place on the surface of the article being polished. Small amounts of anti-caking or drying components may optionally be added e.g. magnesium chloride, calcium chloride, or sodium sulphate.

Minor amounts of other ingredients may also be present such as hydroxyethyl cellulose and isopropyl alcohol.

Hydroxyethyl cellulose increases the viscosity, whilst isopropyl alcohol increases the wetting power of our mixture. When we use silver oxide we can also make a small addition of ammonia which improves the wetting power. Improved wetting power may be necessary if the surface if very dirty or greasy.

It is part of our invention to prepare either powders or pastes involving the various ingredients needed to polish the silver plated article whilst restoring to the article being polished at least as much silver as is being removed by the polishing operation. Our preferred composition includes either silver nitrate or silver oxide together with a sufficient amount of potassium hydrogen tartrate to reduce the nitrate or oxide to silver when water has been added to the powder and the paste is applied to the surface of the silver, together with small amounts of sodium chloride and of Kieselguhr as a conventional polishing agent.

EXAMPLES

The present invention is further illustrated by the following examples.

EXAMPLE 1

A powder was prepared from the following components, all parts quoted being by weight:

Silver nitrate: 2
Potassium hydrogen tartrate: 10
Sodium Chloride: 2
Kieselguhr: 1.85

The ingredients were finely powdered and then mixed together. When the powdered mixture was to be used, water was added to successive amounts of the powder in sufficient quantities to form a paste in each case. The paste was applied to the article to be polished by means of a cloth or brush and after a very short period of not more than amout one minute, coated portions were rubbed with a polishing cloth to remove the paste coating. The result was found to be a fine polish on the treated part of the article and extensive repetitions of this operation were found to reproduce the same result without any indication of thinning of the silver coating of the electroplated article or any appearance of the underlying base metal.

EXAMPLE 2

The following components and parts by weight were used:

Silver oxide: 6
Potassium hydrogen tartrate: 12
Sodium chloride: 2
Kieselguhr: 1.5

These ingredients were again finely powdered and mixed as in Example 1. Portions of the powder were made into pastes with water and applied to an electroplated silver article as in the case of Example 1; this led to a good polish on the treated parts without any indication of any removal of silver, even after a very large number of applications.

EXAMPLE 3

The polishes of Examples 1 and 2 were used on small portions of the surface of an electroplated article, where previous repeated polishings with conventional polishing agents had led to a sufficient thinning or removal of the silver layer for the underlying base metal to be exposed. Repeated applications of paste formed from the powders of Examples 1 and 2 were able, after some time, to cover the exposed portions of base metal sufficiently for the latter to be no longer visible.

EXAMPLE 4

This powder comprised (in parts by weight) the following components:

Silver nitrate: 2
Sodium chloride: 2
Potassium hydrogen tartrate: 14
Iron oxide: 0.5

The silver nitrate and ammonium chloride were finely ground and mixed together and thereafter mixed with powdered potassium hydrogen tartrate and finely ground iron oxide.

Water was added to the resulting mixture to form a paste. This was used on exposed portions of a copper surface as in Example 3, and in each case the copper was eventually covered by a continuous bright film of silver.

EXAMPLE 5

The following ingredients and proportions were employed:

Silver oxide: 4.5
Sodium Chloride*: 15
Potassium hydrogen tartrate: 12

* According to British Standard DS 998/1969 i.e. NaCl 99.96%, $Na_2SO_4$ 0.030% and traces of others including 0.0005% Sodium ferricyanide.

These ingredients finely powdered were mixed together, formed into a paste with a sufficient amount of water and used to polish an electroplated silver article as in Examples 1 and 2 above. A so-called antique or matt finish was obtained which was less bright than that obtained in Examples 1 to 4.

EXAMPLE 6

The same ingredients were powdered and mixed together as in Example 5, together with the addition of 1% of Celite (trade mark), a proprietory form of Kieselguhr sold by Johns Manville Company, U.S.A.

The results obtained with this paste both on unworn portions of an electroplated silver article and on worn or exposed portions were similar to those of Example 5, i.e., so-called antique finish was obtained.

EXAMPLE 7

The following components and parts by weight were used:

Silver nitrate: 4.00
Potassium hydrogen tartrate: 28.0
Sodium chloride: 4.0
Kieselguhr: 1.00
Hydroxyethyl cellulose: 0.1
Water: 10.0
Isopropyl alcohol: 2.0

The solid components were first finely ground and mixed together and thereafter made into a paste form with the 10 parts of water and 2 parts of isopropyl alcohol.

The paste obtained was found to be as effective as those obtained by means of the powders of Examples 1 to 6 above, a bright finish being obtained in this case both on unworn and on exposed portions of electroplated silver articles.

EXAMPLES 8 and 9

The following two compositions were obtained, all parts given being by weight:

| | Example 8 | Example 9 |
|---|---|---|
| Silver nitrate | 2 | — |
| Silver oxide | — | 6 |
| Cream of tartar | 14 | 16 |
| Common salt | 2 | 2 |
| Celite | 1.5 | 2 |

The ingredients in both cases (8 and 9) were finely ground together and made into a powder. The powder was made into a paste with water and rubbed either on unworn or exposed portions of electroplated silver articles; the resulting products were found to have an attractive antique finish at the treated parts.

The following is an additional example which has been found to be satisfactory. All parts are by weight:

EXAMPLE 10

Silver nitrate: 3
Ammonium chloride: 3
Kieselguhr: 0.5
Sodium sulphite ($Na_2SO_3.7H_2O$): 5
Hydroxyethyl cellulose: 0.1

EXAMPLE 11

Silver nitrate: 2
Ammonium chloride: 2
Kieselguhr: 0.3
Sodium metabisulphate: 5

EXAMPLE 12

Silver nitrate: 2
Sodium chloride: 2
Iron oxide (of fine particles size): 0.5
Sodium thiosulphate: 5

EXAMPLE 13

Silver nitrate: 2
Ammonium chloride: 4
Kieselguhr: 0.5
Sodium potassium tartrate: 14

EXAMPLE 14

Silver nitrate: 2
Ammonium chloride: 4
Kieselguhr 0.5
Potassium hydrogen tartrate: 14

EXAMPLE 15

Silver nitrate (1.6 part) is dissolved in water (2 parts) and to this is added a solution of ammonium chloride (0.6 part) in water (3 parts). To the mixture which contains precipitate of silver chloride is added 15 parts of potassium hydrogen tartrate.

When rubbed on copper in the manner previously described a brilliant film of silver is deposited.

We claim:

1. A method of polishing and restoring a silver-plated, in particular an electroplated silver article, comprising the steps of making up a paste by the addition of water to a dry powder free of any toxic components and therefore usable in the home and in hotels, said powder consisting essentially of at least one silver generating component selected from the group consisting of silver oxide, silver nitrate, silver chloride, silver carbonate, silver acetate and silver phosphate, together with at least one reducing component for said silver-generating component, said reducing component being selected from the group consisting of potassium hydrogen tartrate, sodium potassium tartrate, sodium sulfite, sodium metabisulfate and sodium thiosulfate; said silver generating component and said reducing component being in powdered form; applying said paste to at least part of the surface of the silver-plated article; allowing the paste to remain on the surface to which it has been applied for a period of at least a few seconds; and thereafter removing the paste by the application to the coated article of a fabric, the removal of the paste being accompanied by the rubbing of the coated portions of the surface with said fabric.

2. A method as claimed in claim 1, in which silver oxide alone is used as the source of silver.

3. A method as claimed in claim 1, in which silver nitrate alone is used as the source of silver.

4. A method as claimed in claim 1, in which a mixture of silver nitrate and silver oxide is used as the source of the silver.

5. A method as claimed in claim 1, in which said reducing component comprises potassium hydrogen tartrate.

6. A method as claimed in claim 1, in which said reducing component comprises sodium sulphide.

7. A method as claimed in claim 1, in which said powder includes sodium chloride in powdered form.

8. A method as claimed in claim 1, in which said powder includes diatomaceous earth as a polishing component.

9. A method as claimed in claim 8, in which the diatomaceous earth is Kieselguhr.

10. A method as claimed in claim 1, in which said powder includes hydroxyethyl cellulose.

11. A solid, dry formulation free of any toxic components and therefore usable in the home and in hotels for silver polishing and restoration in particular for polishing and restoring electroplated articles, said formulation consisting essentially of in powdered form at least one silver generating component selected from the group consisting of silver oxide, silver nitrate, silver chloride, silver carbonate, silver acetate and silver phosphate; and at least one reducing component for said silver generating component, said reducing component being selected from the group consisting of potassium hydrogen tartrate, sodium potassium tartrate, sodium sulfite, sodium metabisulfate and sodium thiosulfate; said silver generating component and said reducing component being in powdered form and constituting a homogeneous mixture.

12. A solid, dry formulation according to claim 11, which also contains at least one polishing component selected from the group consisting of conventional abrasives and fillers.

13. A solid, dry formulation according to claim 12, which contains at least one anti-caking or drying component inert to the other components.

14. A solid, dry formulation according to claim 13 which contains at least one water absorbing component or swelling component.

15. A solid, dry formulation according to claim 11, which also contains a chloride selected from the group consisting of sodium chloride and ammonium chloride.

16. The method of claim 1 wherein said powder also contains at least one polishing component selected from the group consisting of conventional abrasives and fillers, this component also being in powdered form.

17. The method of claim 1 wherein said powder also contains at least one anti-caking or drying component and at least one water absorbing component or swelling component, these components also being in powdered form.

* * * * *